US009249791B2

(12) United States Patent
Chou

(10) Patent No.: US 9,249,791 B2
(45) Date of Patent: Feb. 2, 2016

(54) AIR COMPRESSOR HAVING COMPACT STRUCTURE

(71) Applicant: Wen San Chou, Tainan (TW)

(72) Inventor: Wen San Chou, Tainan (TW)

( * ) Notice: Subject to any disclaimer, the term of this patent is extended or adjusted under 35 U.S.C. 154(b) by 148 days.

(21) Appl. No.: 14/019,589

(22) Filed: Sep. 6, 2013

(65) Prior Publication Data

US 2015/0071798 A1 Mar. 12, 2015

(51) Int. Cl.

| | |
|---|---|
| ***F04B 35/01*** | (2006.01) |
| ***F04B 39/12*** | (2006.01) |
| ***F04B 39/14*** | (2006.01) |
| ***F04B 53/22*** | (2006.01) |

(52) U.S. Cl.

CPC ..... *F04B 35/01* (2013.01); *F04B 39/12* (2013.01); *F04B 39/14* (2013.01); *F04B 53/22* (2013.01)

(58) Field of Classification Search

CPC ..... F04B 35/01; F04B 39/14; F04B 9/045; F04B 35/04; F04B 9/025; F04B 39/12; F04B 39/121; F04B 53/16; F04B 17/03; F04B 9/04; F04B 53/22

USPC ..... 417/415, 360

See application file for complete search history.

(56) References Cited

U.S. PATENT DOCUMENTS

| | | | | | |
|---|---|---|---|---|---|
| 4,009,971 | A * | 3/1977 | Krohn | F04B 9/02 | 417/223 |
| 5,215,447 | A * | 6/1993 | Wen | F04B 35/04 | 417/319 |
| 6,095,758 | A * | 8/2000 | Chou | F04B 35/04 | 417/374 |
| 6,146,112 | A * | 11/2000 | Chou | F04B 9/045 | 417/360 |
| 6,200,110 | B1 * | 3/2001 | Chou | F04B 35/04 | 417/415 |
| 6,213,725 | B1 | 4/2001 | Chou | | |
| 6,280,163 | B1 * | 8/2001 | Chou | F04B 35/01 | 417/360 |
| 6,315,534 | B1 * | 11/2001 | Chou | F04B 35/04 | 417/360 |
| 6,318,975 | B1 * | 11/2001 | Kost | F04B 17/03 | 417/360 |
| 6,514,058 | B1 | 2/2003 | Chou | | |
| 6,551,077 | B2 * | 4/2003 | Chou | F04B 27/02 | 417/415 |
| 6,655,928 | B2 * | 12/2003 | Chou | F04B 35/00 | 417/360 |
| 6,716,003 | B2 * | 4/2004 | Chen | 417/415 | |
| 6,846,162 | B2 | 1/2005 | Chou | | |
| 7,240,642 | B2 | 7/2007 | Chou | | |
| 7,462,018 | B2 * | 12/2008 | Chou | F04B 35/04 | 417/415 |
| 7,976,290 | B2 * | 7/2011 | Wang | F04B 35/01 | 248/300 |
| 2004/0105766 | A1 * | 6/2004 | Chou | F04B 35/00 | 417/415 |
| 2006/0216168 | A1 * | 9/2006 | Wang | F04B 27/0895 | 417/415 |
| 2007/0077157 | A1 * | 4/2007 | Chou | F04B 35/01 | 417/437 |
| 2007/0264139 | A1 * | 11/2007 | Chou | F04B 9/045 | 417/415 |
| 2008/0237510 | A1 * | 10/2008 | Chou | F04B 35/01 | 251/15 |
| 2011/0076164 | A1 * | 3/2011 | Chou | F04B 53/12 | 417/321 |
| 2012/0189469 | A1 * | 7/2012 | Chou | F04B 35/01 | 417/321 |

* cited by examiner

*Primary Examiner* — Bryan Lettman
(74) *Attorney, Agent, or Firm* — Charles E. Baxley

(57) ABSTRACT

An air compressor device includes a cylinder housing and a supporting plate. The air compressor further comprises a piston engaged in the cylinder housing and having a piston rod, a gear and an eccentric member attached to the supporting plate with a shaft. The eccentric member includes an eccentric pin coupled to the piston rod. A motor includes a protrusion engaged into an orifice of the supporting plate, with a spindle extended out of the protrusion and extended through the orifice of the supporting plate. The motor further includes a pinion attached to the spindle and engaged with the gear. The pinion includes an outer diameter greater than an outer diameter of the protrusion of the motor.

3 Claims, 6 Drawing Sheets

AIR COMPRESSOR HAVING COMPACT STRUCTURE

BACKGROUND OF THE INVENTION

1. Field of the Invention

The present invention relates to an air compressor device, and more particularly to an air compressor device including a compact structure or configuration having a relatively decreased or reduced size or volume or dimension or standard for facilitating the storing and transportation purposes or function or effect for the air compressor device.

2. Description of the Prior Art

Typical air compressors comprise a cylinder housing attached or secured to a base and having a piston slidably disposed therein, and a motor secured to the base and coupled to the piston of the cylinder housing for actuating or driving the piston of the cylinder housing in a reciprocating action, in order to generate a pressurized air of a greater air pressure and a decreased flowing quantity and for supplying the pressurized air to inflate various air facilities, such as tires, air beds, air cushions, hovercrafts, etc.

The cylinder housing normally includes an outlet receptacle having a compartment formed therein and having one or more outlet ports communicative with the compartment of the outlet receptacle for selectively or changeably attaching and securing or coupling various parts or elements or attachments or facilities, such as the pressure gauges, the air nozzles, the relief valves, the safety valves or the like.

The applicant has developed various kinds of typical air compressors, including at least U.S. Pat. No. 6,213,725 to Chou, U.S. Pat. No. 6,514,058 to Chou, U.S. Pat. No. 6,655,928 to Chou, U.S. Pat. No. 6,846,162 to Chou, U.S. Pat. No. 7,240,642 to Chou, and U.S. Pat. No. 7,462,018 to Chou each of which also comprise a piston slidably disposed within a cylinder housing, a spring valve having one end secured to the piston and having the other end for selectively blocking an air aperture of the piston, in order to control the air to flow through the piston, and a motor secured to the base and coupled to the piston of the cylinder housing with a gearing mechanism for actuating or driving or forcing the piston of the cylinder housing to move in the reciprocating action relative to the cylinder housing, and an outlet receptacle extended or formed on top of the cylinder housing and having a compartment formed therein for receiving the pressurized air from the cylinder housing and having one or more outlet ports communicative with the compartment of the outlet receptacle for selectively or changeably attaching and securing or coupling various parts or elements or attachments or facilities, such as the pressure gauges, the air nozzles, the relief valves, the safety valves or the like.

However, the attachment or engagement of the motor to the supporting base and/or the cylinder housing, or the supporting base may require a greatly or relatively increased size or volume or dimension or standard, or the supporting base is required to include a greatly or relatively increased size or volume or dimension or standard that is adverse for storing and transportation purposes and that may greatly increase the manufacturing fee for the air compressors.

The present invention has arisen to mitigate and/or obviate the afore-described disadvantages of the conventional structures for the air compressors.

SUMMARY OF THE INVENTION

The primary objective of the present invention is to provide an air compressor device including a compact structure or configuration having a relatively decreased or reduced size or volume or dimension or standard for facilitating the storing and transportation purposes or effect for the air compressor device.

In accordance with one aspect of the invention, there is provided an air compressor device comprising a supporting base including a supporting plate and a cylinder housing, the cylinder housing including a chamber formed therein, and including an outlet receptacle extended upwardly from the cylinder housing for receiving a pressurized air from the chamber of the cylinder housing, the supporting plate including an orifice and an aperture formed therein, a piston slidably received or engaged in the chamber of the cylinder housing and having a piston rod extended from a piston head, a shaft rotatably engaged through the aperture of the supporting plate, a gear attached to the shaft and rotatable relative to the supporting plate, an eccentric member attached to the gear and including an eccentric pin extended from the eccentric member and coupled to the piston rod in order to actuate and move the piston head of the piston relative to the cylinder housing in a reciprocating action, and a motor including a forwardly extended protrusion engaged into the orifice of the supporting plate, and including a spindle rotatably extended out of the protrusion and extended through the orifice of the supporting plate, and including a pinion attached to the spindle and meshed and engaged with the gear for allowing the gear to be driven by the motor with the pinion, and for allowing the piston head and the piston rod to be moved relative to the cylinder housing in the reciprocating action by the eccentric member and the eccentric pin, and the pinion including an outer diameter (D) greater than an outer diameter (d) of the protrusion of the motor.

The supporting plate includes a plurality of teeth extended radially and inwardly into the orifice of the supporting plate for forming a plurality of slots between the teeth, the teeth of the supporting plate include a dedendum having an inner diameter (W) no less than the outer diameter (D) of the pinion of the motor for allowing the pinion of the motor to be engaged through the orifice of the supporting plate.

The protrusion of the motor includes an outer diameter (d) no greater than an inner diameter (a) of an addendum of the teeth of the supporting plate for allowing the protrusion of the motor to be engaged into the orifice of the supporting plate and to be snugly fitted or engaged with the addendum of the teeth of the supporting plate.

The motor includes at least one retaining hole formed therein, and the supporting plate includes at least one positioning projection extended outwardly therefrom and located beside the orifice of the supporting plate and engaged into the retaining hole of the motor for solidly and stably anchoring the motor to the supporting plate and for preventing the motor from being pivoted or rotated relative to the supporting plate.

The supporting plate includes at least one engaging hole engaged with a fastener which is engaged with the motor for solidly and stably anchoring or retaining or attaching or mounting or securing or positioning the motor to the supporting plate.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
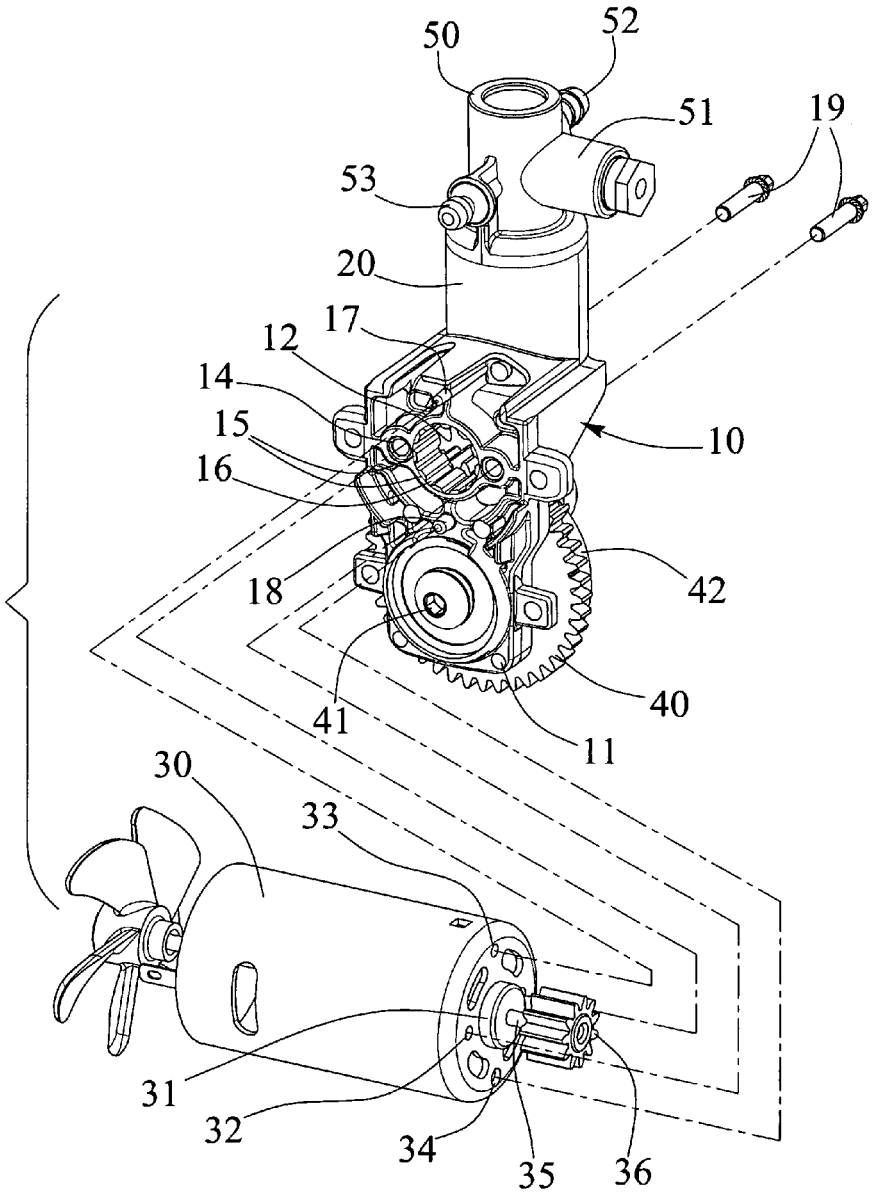
FIG. 1 is a partial exploded view of an air compressor device in accordance with the present invention.
Figure 2:
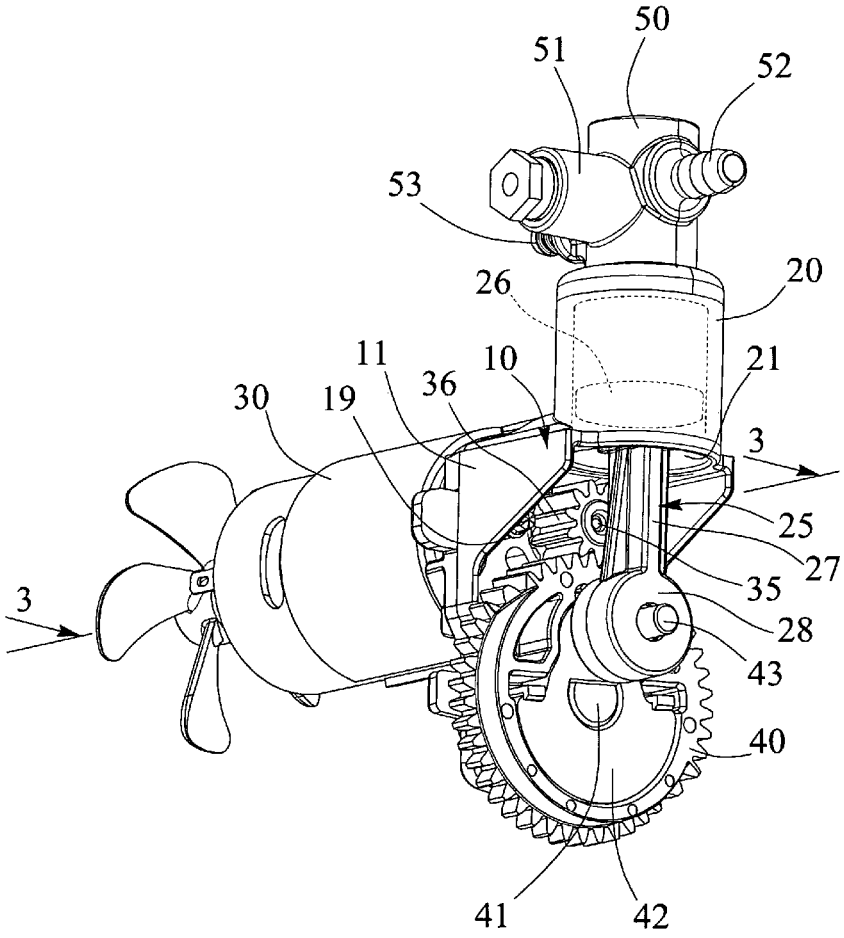
FIG. 2 is a perspective view of the air compressor device.
Figure 3:
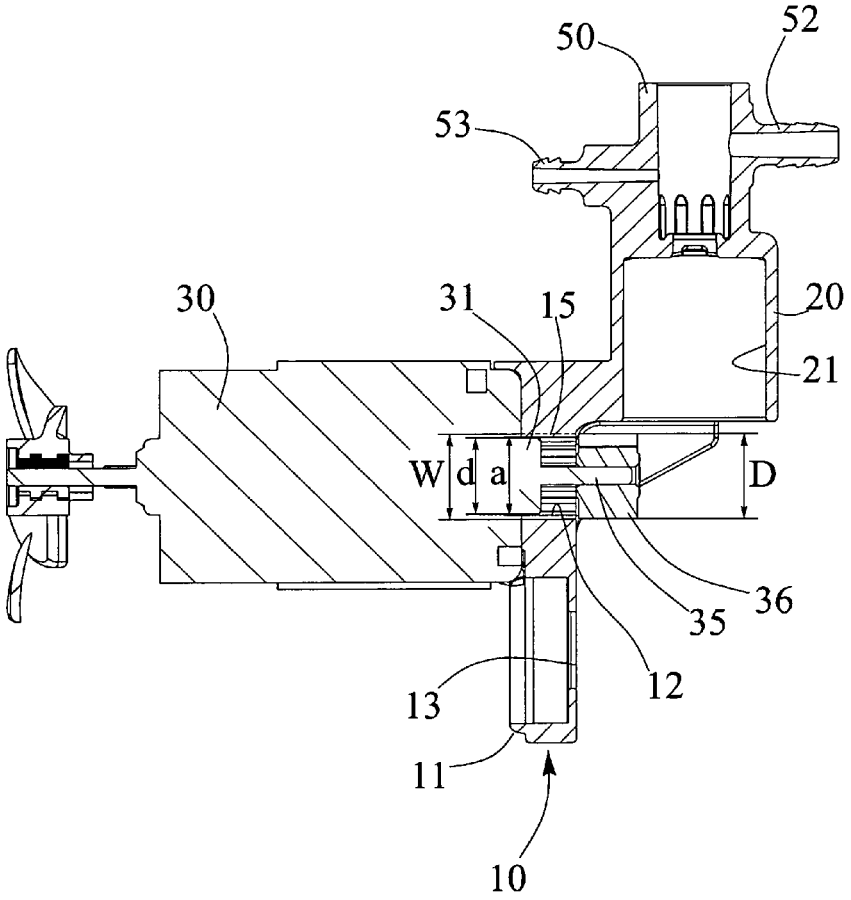
FIG. 3 is a partial cross sectional view of the air compressor device, taken along lines 3-3 of FIG. 2.
Figure 4:
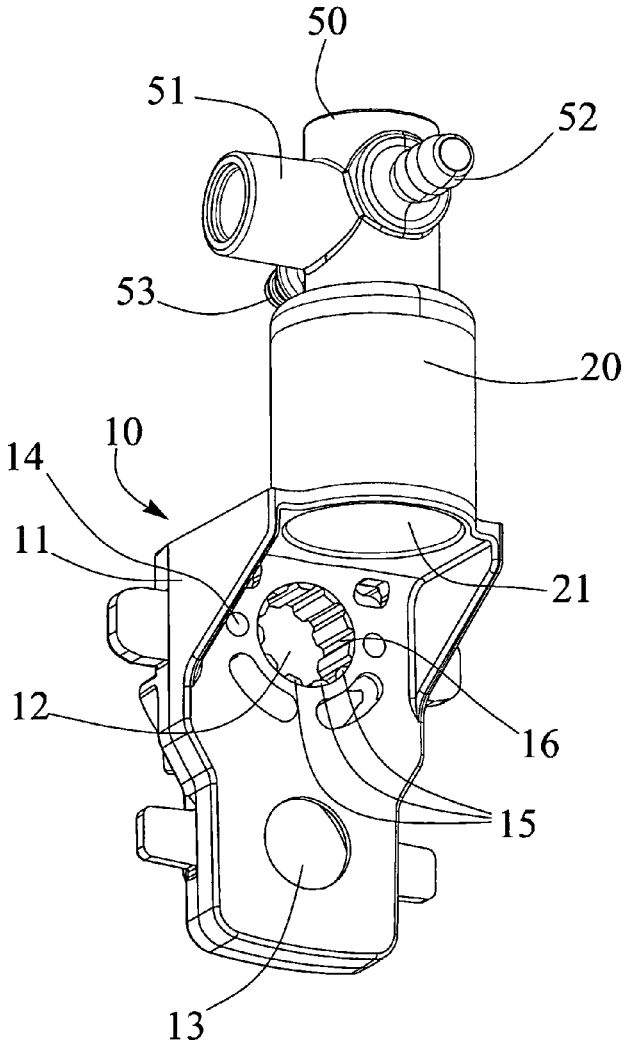
FIG. 4 is another perspective view similar to FIG. 2, in which some of the parts or elements of the air compressor device have been removed or deleted for showing the inner structure of the air compressor device.
Figure 5:
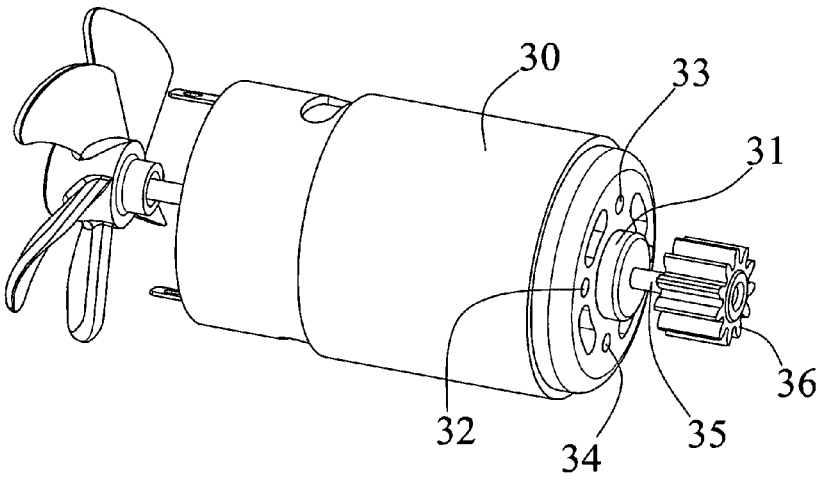
FIG. 5 is a perspective view illustrating the motor of the air compressor device.

Referring to the drawings, and initially to FIGS. 1-4, an air compressor device in accordance with the present invention comprises a supporting base 10 including a supporting plate 11 and a cylinder housing 20 provided on or extended from the supporting plate 11 and preferably, but not necessarily formed integral with the supporting plate 11. For example, the supporting plate 11 and the cylinder housing 20 may be formed integral with each other, as shown in FIGS. 3 and 4, with the molding or mold-injection processes, for example, or alternatively, the cylinder housing 20 may include one or more projections (not shown) extended therefrom and engaged with corresponding hubs or tubular members (not shown) of the supporting plate 11 for detachably attaching or mounting or securing the cylinder housing 20 to the supporting plate 11.

The cylinder housing 20 includes a chamber 21 formed therein and formed or defined by an inner peripheral surface and opened downwardly for slidably receiving or engaging with a piston 25 therein (FIG. 2), the piston 25 includes an extension or piston rod 27 extended from a piston head 26 and is slidable in a reciprocating action in the chamber 21 of the cylinder housing 20 for generating a pressurized air. As best shown in FIG. 4, the supporting plate 11 includes an orifice 12 and an aperture 13 formed therein, and one located above the other, for example, the orifice 12 is located above the aperture 13 of the supporting plate 11, and one or more (such as two) anchoring or engaging holes 14 are also formed in the supporting plate 11 and disposed or located around or beside the orifice 12 of the supporting plate 11 for receiving or engaging with latches or pins or catches or fasteners 19.

The supporting plate 11 further includes an internal gear or a number of teeth 15 extended radially and inwardly into the orifice 12 of the supporting plate 11 for forming or defining a number of gaps or spaces or slots 16 between the teeth 15, in which the slots 16 and/or the teeth 15 of the supporting plate 11 are disposed or extended or arranged substantially perpendicular to the supporting plate 11. The supporting plate 11 further includes one or more (such as two) anchoring or engaging or retaining or latching or catching or positioning members 17, 18, such as keys or pegs or projections 17, 18 (FIG. 1) formed or provided therein, and preferably, but not necessary that the positioning members or projections 17, 18 are disposed or located around or beside the orifice 12 of the supporting plate 11, for example, the projection 17 is located above the other projection 18.

As shown in FIGS. 1-3 and 5-6, a motor 30 may be attached or secured to the upper portion of the supporting plate 11 with such as latches or pins or catches or fasteners 19, and includes a swelling or bulge or protrusion 31 extended forwardly therefrom for engaging into or with the orifice 12 of the supporting plate 11 and for attaching or mounting or securing or coupling to the supporting plate 11, and includes one or more (such as two) anchoring or engaging or retaining or latching or positioning holes 32 formed therein and disposed or located around or beside the protrusion 31 for receiving or engaging with the latches or pins or catches or fasteners 19 and for solidly and stably anchoring or retaining or attaching or mounting or securing or positioning the motor 30 to the supporting plate 11.

The motor 30 further includes one or more (such as two) anchoring or engaging or positioning or latching or retaining holes 33, 34 formed therein and one located above the other, for example, the retaining hole 33 is located above the other retaining hole 34 of the motor 30 for receiving or engaging with the projections 17, 18 of the supporting plate 11 respectively and for further solidly and stably anchoring or retaining or attaching or mounting or securing or positioning the motor 30 to the supporting plate 11. The motor 30 further includes a spindle 35 (FIGS. 1-3 and 5-6) pivotally or rotatably extended out of the protrusion 31 and extended through the orifice 12 of the supporting plate 11, and includes a pinion 36 attached or mounted or secured to the spindle 35 thereof for coupling to and for moving or driving the piston 25 relative to the cylinder housing 20.

A gear 40 is rotatably attached to the lower portion of the supporting plate 11 with one or more bearings (not shown) and a shaft 41 (FIGS. 1, 2) which is pivotally or rotatably engaged through the aperture 13 of the supporting plate 11, and an eccentric member 42 is attached or secured to the gear 40 with such as fasteners (not shown) or with the molding or mold-injection processes and may thus be rotated in concert with the gear 40, and includes a crank or an eccentric pin 43 extended therefrom and coupled to the free end portion 28 of the piston rod 27 of the piston 25 (FIG. 2) in order to actuate or to move the piston 25 relative to the cylinder housing 20, or to actuate or to move the piston head 26 along the cylinder housing 20 in the reciprocating actions.

As also shown in FIG. 2, the pinion 36 of the motor 30 is meshed or engaged with the gear 40 for allowing the gear 40 to be pivoted or rotated or driven by the motor 30 with the pinion 36, and thus for allowing the piston head 26 of the piston 25 to be actuated to move along or relative to the cylinder housing 20 in reciprocating actions by the eccentric member 42 and the eccentric pin 43. The cylinder housing 20 includes an outlet tube or barrel or receptacle 50 extended upwardly or outwardly from the top of the cylinder housing 20 for receiving the pressurized air from the chamber 21 of the cylinder housing 20, and the outlet receptacle 50 further includes one or more ducts 51, 52, 53 (FIGS. 1-4) extended outwardly therefrom and communicative with the outlet receptacle 50, for receiving the pressurized air from the outlet receptacle 50.

The ducts 51, 52, 53 may be coupled to various kinds of facilities that require pressurized air supplied thereto, such as nozzle (not shown), hose (not shown), pressure gauge (not shown), cap or lid (not shown), spring-biased check valve (not shown), relief valve (not shown), safety valve (not shown), or the like, in which the above-described structure or configuration for the air compressor device, including the nozzle and the hose for coupling to the facilities that require pressurized air supplied thereto, the pressure gauge, the cap or lid, the spring-biased check valve, the relief valve, the safety valve or the like is typical and is not related to the present invention and will not be described in further details.

Figure 6:
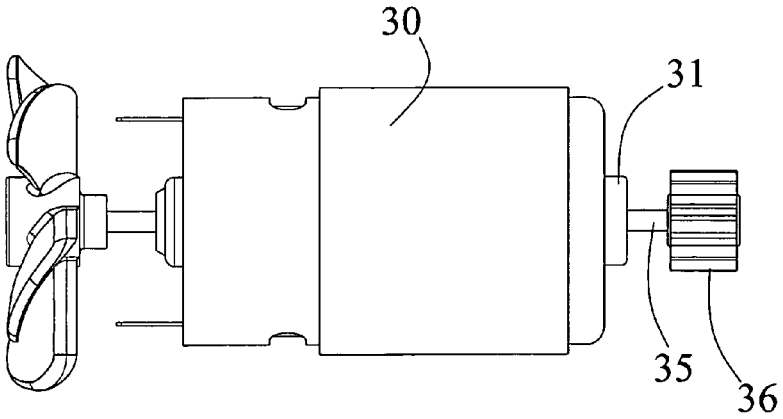
FIG. 6 is a side plan schematic view of the motor of the air compressor device.
Figure 7:
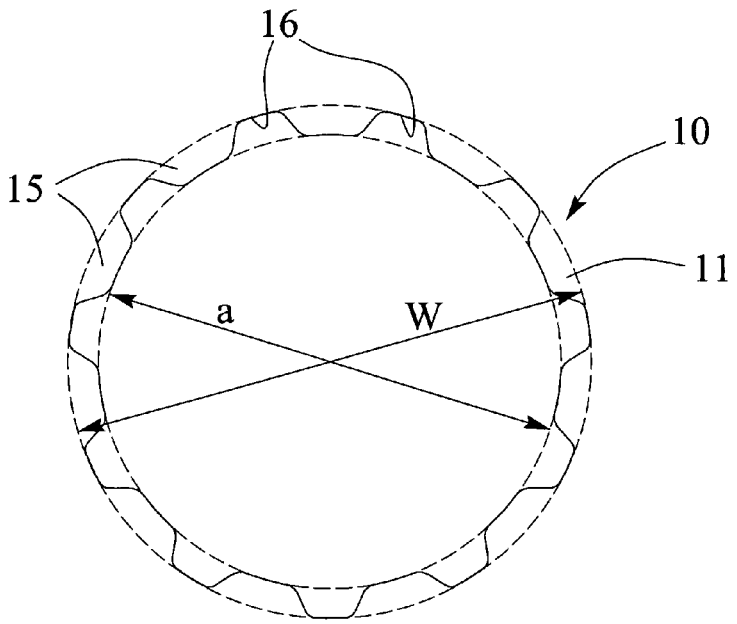
FIG. 7 is an enlarged partial plan schematic view illustrating the supporting base of the air compressor device.

As shown in FIG. 7, the inner diameter (a) of the addendum or the teeth 15 of the supporting plate 11 is defined as (a), and the diameter, or the inner diameter (W) of the orifice 12 or of the dedendum or the root portion of the teeth 15 of the supporting plate 11 is defined as (W), and as shown in FIGS. 3, 6, the outer diameter (D) of the pinion 36 of the motor 30 is equal to or slightly smaller than, or no greater than the inner diameter (W) of the dedendum or the root portion of the teeth 15 of the supporting plate 11 for allowing the pinion 36 of the motor 30 to be engaged into or through the orifice 12 of the supporting plate 11, and the outer diameter (d) of the protrusion 31 of the motor 30 is equal to or slightly smaller than, or no greater than the inner diameter (a) of the addendum or the teeth 15 of the supporting plate 11 for allowing the protrusion 31 of the motor 30 to be engaged into the orifice 12 of the supporting plate 11 and contacted or engaged with the addendum or the teeth 15 of the supporting plate 11, and thus for allowing the protrusion 31 and/or the motor 30 to be solidly and stably attached or mounted or secured to the supporting plate 11.

In operation, as shown in FIG. 2, the piston head 26 of the piston 25 may be actuated or moved relative to the cylinder housing 20 in the reciprocating actions by the motor 30 with the pinion 36, the gear 40, the eccentric member 42 and the eccentric pin 43, in order to generate a pressurized air, and to allow the pressurized air to flow into the outlet receptacle 50, and then to flow out through either or all of the ducts 51, 52, 53, and to allow the air pressure within the cylinder housing 20 and/or the outlet receptacle 50 to be detected and shown by the pressure gauge (not shown), and to allow the pressurized air to be supplied into the facilities that require pressurized air supplied thereto, with the nozzle, and/or to allow the pressurized air to be relieved via the relief valve (not shown) when the cylinder housing 20 and/or the outlet receptacle 50 is over-pressurized.

As shown in FIG. 3, the outer diameter (D) of the pinion 36 of the motor 30 which is equal to or slightly smaller than, or no greater than the inner diameter (W) of the dedendum or the root portion of the teeth 15 of the supporting plate 11 may be engaged into or through the orifice 12 of the supporting plate 11, and the outer diameter (d) of the protrusion 31 of the motor 30 which is equal to or slightly smaller than, or no greater than the inner diameter (a) of the addendum or the teeth 15 of the supporting plate 11 may be engaged into the orifice 12 of the supporting plate 11 and snugly contacted or engaged with the addendum or the teeth 15 of the supporting plate 11, and thus for allowing the protrusion 31 and/or the motor 30 to be solidly and stably attached or mounted or secured to the supporting plate 11 without vibration, and thus for allowing the working life of the air compressor device to be suitably increased.

Accordingly, the air compressor device in accordance with the present invention includes a compact structure or configuration having a relatively decreased or reduced size or volume or dimension or standard for facilitating the storing and transportation purposes or effect for the air compressor device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An air compressor device comprising:

a supporting base including a supporting plate and a cylinder housing, said cylinder housing including a chamber formed therein, and including an outlet receptacle extended upwardly from said cylinder housing for receiving a pressurized air from said chamber of said cylinder housing, said supporting plate including an orifice and an aperture formed therein, said supporting plate including a plurality of teeth extended radially and inwardly into said orifice of said supporting plate for forming a plurality of slots between said teeth, a piston slidably received in said chamber of said cylinder housing and having a piston rod extended from a piston head, a shaft rotatably engaged through said aperture of said supporting plate, a gear attached to said shaft and rotatable relative to said supporting plate, an eccentric member attached to said gear and including an eccentric pin extended from said eccentric member and coupled to said piston rod in order to actuate and move said piston head of said piston relative to said cylinder housing in a reciprocating action, and a motor including a forwardly extended protrusion engaged into said orifice of said supporting plate, and including a spindle rotatably extended out of said protrusion and extended through said orifice of said supporting plate, and including a pinion attached to said spindle and meshed and engaged with said gear for allowing said gear to be driven by said motor with said pinion, and for allowing said piston head and said piston rod to be moved relative to said cylinder housing in the reciprocating action by said eccentric member and said eccentric pin, and said pinion including an outer diameter greater than an outer diameter of said protrusion of said motor, and said teeth of said supporting plate including a dedendum having an inner diameter no less than the outer diameter of said pinion of said motor for allowing said pinion of said motor to be engaged through said orifice of said supporting plate, wherein said protrusion of said motor includes the outer diameter which is no greater than an inner diameter of an addendum of said teeth of said supporting plate for allowing said protrusion of said motor to be engaged into said orifice of said supporting plate and engaged with said teeth of said supporting plate.

2. The air compressor device as claimed in claim 1, wherein said motor includes at least one retaining hole formed therein, and said supporting plate includes at least one positioning projection extended outwardly therefrom and located beside said orifice of said supporting plate and engaged into said at least one retaining hole of said motor for anchoring said motor to said supporting plate.

3. The air compressor device as claimed in claim 1, wherein said supporting plate includes at least one engaging hole engaged with a fastener which is engaged with said motor.

* * * * *